US009574304B2

(12) United States Patent
Oguchi et al.

(10) Patent No.: US 9,574,304 B2
(45) Date of Patent: Feb. 21, 2017

(54) SHEET-MANUFACTURING DEVICE AND METHOD FOR CONTROLLING SHEET-MANUFACTURING DEVICE

(71) Applicant: SEIKO EPSON CORPORATION, Tokyo (JP)

(72) Inventors: Yuki Oguchi, Okaya (JP); Shunichi Seki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/779,878

(22) PCT Filed: Mar. 18, 2014

(86) PCT No.: PCT/JP2014/001550

§ 371 (c)(1),
(2) Date: Sep. 24, 2015

(87) PCT Pub. No.: WO2014/156058

PCT Pub. Date: Oct. 2, 2014

(65) Prior Publication Data

US 2016/0053435 A1 Feb. 25, 2016

(30) Foreign Application Priority Data

Mar. 27, 2013 (JP) ..... 2013-065806
Feb. 13, 2014 (JP) ..... 2014-025121

(51) Int. Cl.
*D21B 1/06* (2006.01)
*D21F 1/48* (2006.01)
(Continued)

(52) U.S. Cl.
CPC ..... *D21F 1/48* (2013.01); *D04H 1/732* (2013.01); *D21B 1/06* (2013.01); *D21B 1/063* (2013.01); *D21F 11/00* (2013.01); *D21H 11/14* (2013.01)

(58) Field of Classification Search
CPC ..... D21B 1/06; D21F 11/00; D21F 1/48
(Continued)

(56) References Cited

U.S. PATENT DOCUMENTS 8,882,965 B2 * 11/2014 Yamagami ..... D21B 1/08 162/261

FOREIGN PATENT DOCUMENTS

JP 52-137006 A 11/1977
JP 11-293578 A 10/1999
(Continued)

OTHER PUBLICATIONS

PCT/JP2014/001550 International Search Report dated Jun. 17, 2014.

(Continued)

*Primary Examiner* — Mark Halpern
(74) *Attorney, Agent, or Firm* — Workman Nydegger

(57) ABSTRACT

A sheet-manufacturing device that manufactures a sheet of which the quality is stable, by controlling airflow to be constant and causing a defibrated state to be constant. A sheet-manufacturing device including a defibrating unit configured to generate a defibrated material by defibrating a defibration object; a temperature acquiring unit configured to acquire a temperature of the defibrating unit; and a control unit configured to change a mass flow rate of the air including the defibrated material transported from the defibrating unit.

5 Claims, 3 Drawing Sheets

(51) Int. Cl.
*D04H 1/732* (2012.01)
*D21F 11/00* (2006.01)
*D21H 11/14* (2006.01)

(58) Field of Classification Search
USPC ..... 162/198, 263, 261
See application file for complete search history.

(56) References Cited

FOREIGN PATENT DOCUMENTS

| | | |
|---|---|---|
| JP | 2012-144819 | 8/2012 |
| JP | 2012-144826 | 8/2012 |
| WO | 2012-095928 | 7/2012 |
| WO | WO 2012/095928 | 7/2012 |

OTHER PUBLICATIONS

European Search Report for Application No. 14772878.6 dated Oct. 25, 2016.

* cited by examiner

SHEET-MANUFACTURING DEVICE AND METHOD FOR CONTROLLING SHEET-MANUFACTURING DEVICE

This application is a 371 of PCT/JP2014/001550 filed 18 Mar. 2014.

TECHNICAL FIELD

The invention relates to a sheet-manufacturing device and a method for controlling a sheet-manufacturing device.

BACKGROUND ART

In the related art, since waste paper discharged from offices includes waste paper having confidential matters, in view of confidentiality, it is preferable that the waste paper is processed in the offices. Since a wet sheet-manufacturing device using a large quantity of water is not suitable in a small office, a dry sheet-manufacturing device having a simplified structure is suggested (for example, see PTL 1).

CITATION LIST

Patent Literature

PTL 1: Japanese Unexamined Patent Application Publication No. 2012-144819

SUMMARY OF INVENTION

Technical Problem

However, in the sheet-manufacturing device described above, there has been a problem in that, for example, if the temperature of a defibrating unit that defibrates paper (waste paper) changes, air density changes, transportation force by the airflow is caused to not be constant, and thus the defibrated state becomes unstable. This is a problem that is not limited to waste paper but also occurs even in a case where other raw materials are defibrated.

Solution to Problem

The invention is to solve at least a unit of the problem described above, and can be performed by the following embodiments or application examples.

APPLICATION EXAMPLE 1

According to this application example, a sheet-manufacturing device including: a defibrating unit configured to generate a defibrated material by defibrating a defibration object; a temperature acquiring unit configured to acquire a temperature of the defibrating unit; and a control unit configured to change a mass flow rate of the air including the defibrated material transported from the defibrating unit.

According to this configuration, since the mass flow rate of the air including defibrated materials is changed based on the acquired temperature of the defibrating unit, the change of the mass flow rate of the air generated by the change of the temperature of the defibrating unit can be adjusted, such that defibration can be stably driven. Accordingly, the defibrated state becomes stable, such that an excellent sheet can be manufactured.

APPLICATION EXAMPLE 2

In the sheet-manufacturing device according to the application example above, when the acquired temperature is higher, the control unit causes the mass flow rate to be higher than that when the acquired temperature is lower.

When the temperature of the defibrating unit is higher, the density of the air decreases, such that the transportation properties of the defibrated materials decrease. Then, an excessive defibrated state in which fibers are more defibrated progresses, fibers become short, and thus the strength of the sheet that is formed decreases. Therefore, according to this configuration, if the temperature of the defibrating unit is higher, the transportation properties of the defibrated material can be increased by causing the mass flow rate to be greater than that when the temperature of the defibrating unit is lower. Accordingly, the excessive defibratied state can be cancelled.

APPLICATION EXAMPLE 3

The sheet-manufacturing device according to the application example above further includes a suction unit that configured to suction the defibrated material, in which when the acquired temperature is higher, the control unit configured to cause a suction force of the suction unit to be greater than that when the acquired temperature is lower.

According to this configuration, if the acquired temperature is higher, the mass flow rate of the air can be caused to be significant by causing the suction force of the suction unit to be significant. Accordingly, the transportation properties of the defibrated material can be increased.

APPLICATION EXAMPLE 4

In the sheet-manufacturing device according to the application example above, the defibrating unit includes a rotary blade that rotates, and when the acquired temperature is higher, the control unit configured to cause a rotation speed of the rotary blade to be greater than that when the acquired temperature is lower.

According to this configuration, if the acquired temperature is higher, the mass flow rate of the air can be caused to be great by causing the rotation speed of the rotary blade to be greater, such that the transportation properties of the defibrated material can be increased.

APPLICATION EXAMPLE 5

In the sheet-manufacturing device according to the application example above, the temperature acquiring unit configured to acquire the temperature inside the defibrating unit.

According to this configuration, since the temperature inside the defibrating unit can be acquired, the temperature can be easily acquired.

APPLICATION EXAMPLE 6

In the sheet-manufacturing device according to the application example above, an upstream side and a downstream side of the defibrating unit in a transporting direction of the defibrated material are connected to an upstream transporting path and a downstream transporting path, respectively, and the temperature acquiring unit configured to acquire temperatures inside the upstream transporting path and inside the downstream transporting path.

According to this configuration, since the temperatures of the upstream side and the downstream side of the defibrating unit are obtained, the temperature can be easily acquired.

DESCRIPTION OF EMBODIMENTS

Hereinafter, embodiments of the invention are described with reference to the drawings. In addition, in the respective drawings, in order to cause the respective members to be recognizable, dimensions of the respective members are illustrated to be different from those in reality.

First, configurations of a sheet-manufacturing device are described. The sheet-manufacturing device is based on, for example, a technique of reproducing a raw material (defibration object) such as waste paper (used paper) or a pulp sheet into a new sheet. Also, the sheet-manufacturing device includes a defibrating unit that generates a defibrated material by defibrating a defibration object, a temperature acquiring unit that acquires a temperature of the defibrating unit, and a control unit that changes the mass flow rate of the air including the defibrated material transported from the defibrating unit. In addition, a raw material as a defibration material to be supplied to a sheet-manufacturing device according to the embodiment is, for example, waste paper (raw material PU) such as A4 size which is typically used in offices, recently. Hereinafter, specific descriptions are provided.

Figure 1:
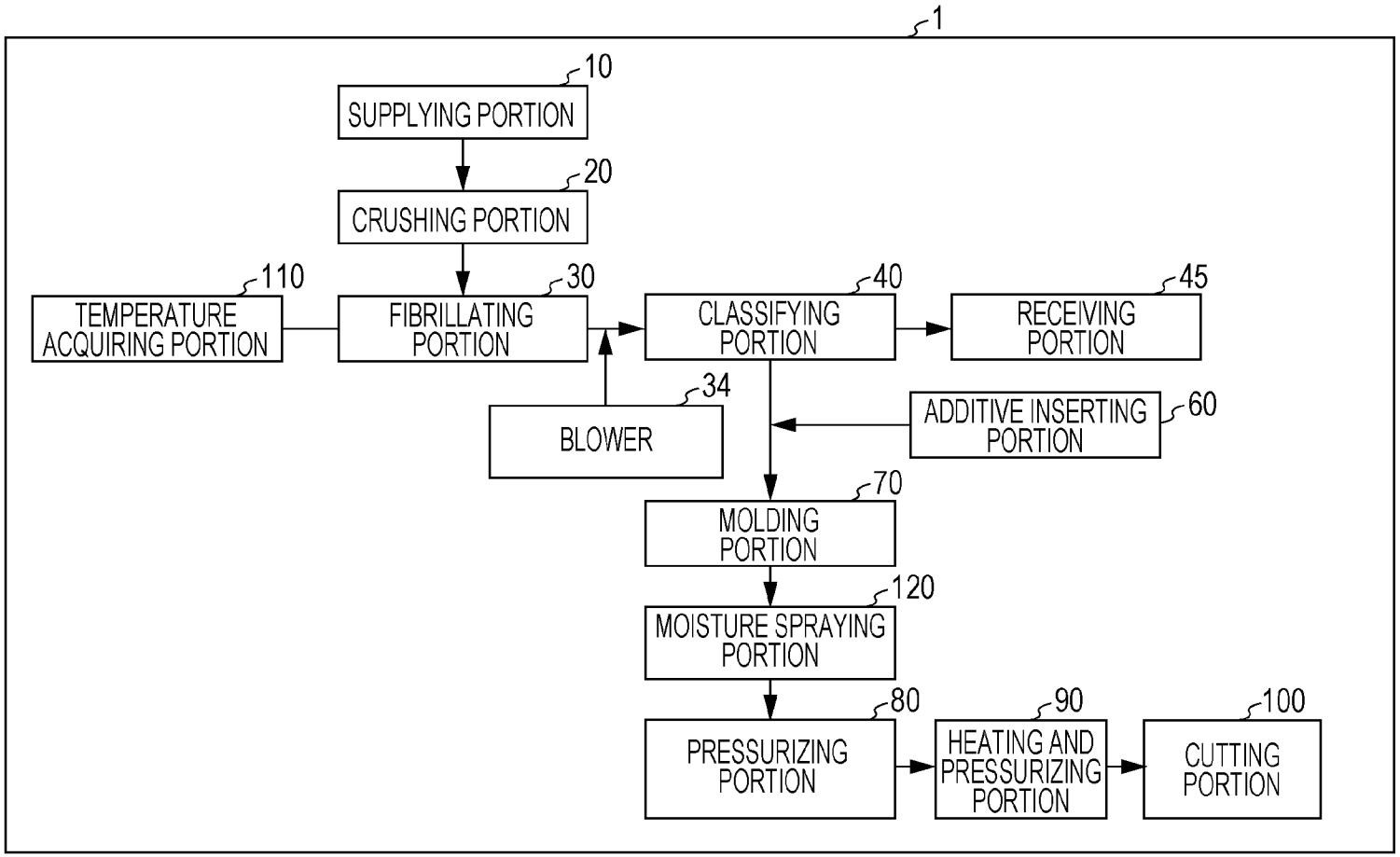
FIG. 1 is a diagram schematically illustrating a configuration of a sheet-manufacturing device.
Figure 2:
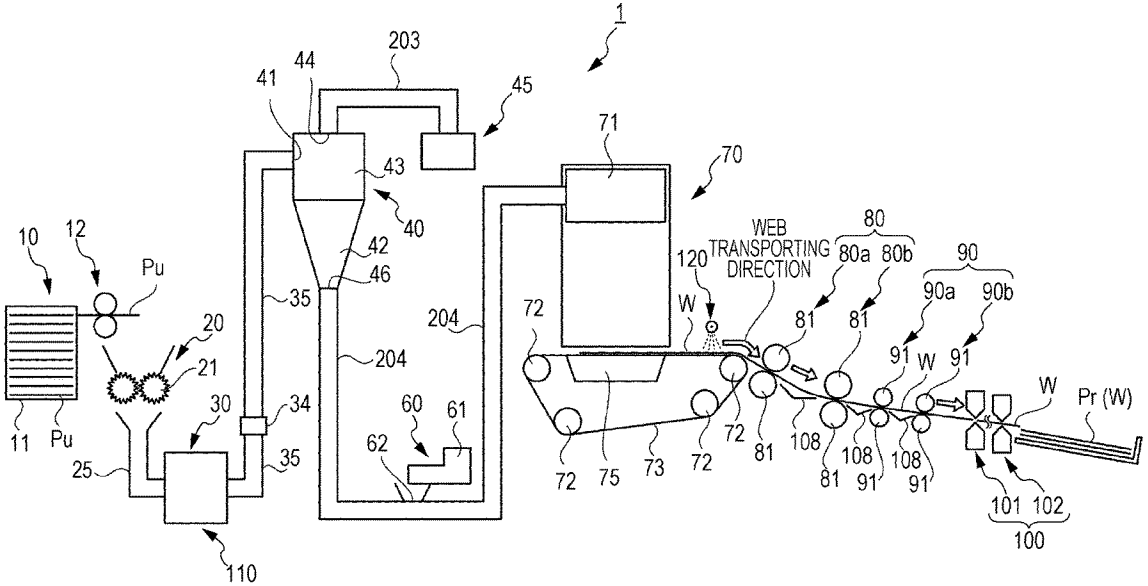
FIG. 2 is another diagram schematically illustrating the configuration of the sheet-manufacturing device.

FIGS. 1 and 2 are diagrams schematically illustrating a configuration of a sheet-manufacturing device. As illustrated in FIGS. 1 and 2, a sheet-manufacturing device 1 includes a supplying unit 10, a crushing unit 20, a defibrating unit 30, a classifying unit 40, a receiving unit 45, an additive agent feeding unit 60, a forming unit 70, a moisture spraying unit 120, a pressurizing unit 80, a heating and pressurizing unit 90, and a cutting unit 100. The sheet-manufacturing device 1 further includes a temperature acquiring unit 110 that acquires a temperature of the defibrating unit 30 and a blower 34 that adjusts the mass flow rate of the air. Also, the sheet-manufacturing device 1 includes a control unit (not illustrated) that controls these members.

The supplying unit 10 is to provide the raw material PU as a product to be defibrated to the crushing unit 20. The supplying unit 10 includes, for example, a tray 11 that disposing the plural raw materials PU in an overlapped manner and an automatic feeding mechanism 12 that can continuously insert the raw materials PU disposed in the tray 11 into the crushing unit 20.

The crushing unit 20 cuts the supplied raw material PU into squares strips of several centimeters. The crushing unit 20 includes a crushing blade 21, and configures a device in which the cutting width of a blade of a general shredder is widened. Accordingly, the supplied raw materials PU can be easily cut into strips. Also, the strips are supplied to the defibrating unit 30 via an upstream transporting path 25.

The defibrating unit 30 includes a rotary blade that rotates and defibrates the strips supplied from the crushing unit 20 so as to have fiber shapes (cotton shape). In addition, the defibrating unit 30 according to the embodiment performs dry defibration in the air, not defibration in water.

For example, a disc refiner, Turbo Mill (manufactured by Freund-Turbo Corporation), Ceren Miller (manufactured by Masuko Sangyo Co., Ltd.), and a dry defibration device including a wind generating mechanism are appropriately applied to the defibrating unit 30. The size of strips inserted to the dry defibrating unit 30 may be the same size as those discharged by a general shredder.

Printed ink or toner, anti-bleeding materials, or other coating materials on the raw material or the like are also released (separated) from a state of being attached on the fiber by a defibration process of the defibrating unit 30 (hereinafter, referred to as "ink particles"). Accordingly, the defibrated material discharged from the defibrating unit 30 is fibers and ink particles obtainable by defibrating the strips.

Also, the defibrating unit 30 is a mechanism that generates airflow by the rotation of the rotary blade such that the defibrated material moves in the defibrating unit 30. A downstream transporting path 35 that transports the defibrated materials by causing the defibrated materials to ride on the airflow is provided between the defibrating unit 30 and the classifying unit 40, and the blower 34 that controls the speed of the airflow is arranged in the downstream transporting path 35. The defibrated material is transported to the classifying unit 40 at a speed appropriate for being classified by the blower 34. The blower 34 may have a function of suctioning the defibrated materials from the defibrating unit 30. In this case, the blower 34 becomes a suction unit. In addition, another suction unit may be included between the blower 34 and the defibrating unit 30. The suction unit can control the suction force. The amount of the defibrated materials that move in the defibrating unit 30 can be controlled by controlling the suction unit such as the blower 34, such that the mass flow rate of the air including the defibrated materials can be controlled.

Figure 3:
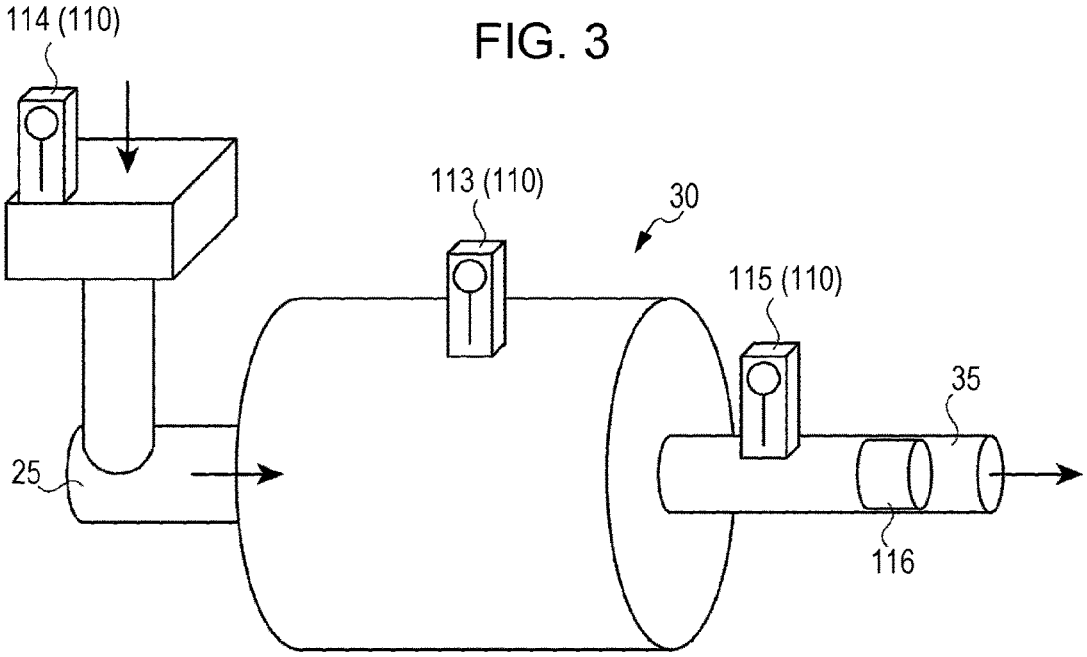
FIG. 3 is a diagram schematically illustrating a configuration near the defibrating unit.

FIG. 3 is a diagram schematically illustrating a configuration near the defibrating unit. Here, a first thermometer 113, a second thermometer 114, and a third thermometer 115, as the temperature acquiring unit 110 that acquires the temperature, are provided near the defibrating unit 30.

As illustrated in FIG. 3, the first thermometer 113 that acquires the temperature of the defibrating unit 30 is provided in the defibrating unit 30. The first thermometer 113 measures the temperature inside of the defibrating unit 30. In addition, the second thermometer 114 that measures the temperature inside the upstream transporting path 25 and the third thermometer 115 that measures the temperature inside the downstream transporting path 35 are provided in the upstream transporting path 25 and the downstream transporting path 35, respectively connected to the upstream side and the downstream side of the transporting direction of the defibrated materials of the defibrating unit 30.

Also, the suction amount of the blower 34 as the suction unit is controlled in response to the temperatures acquired by the first thermometer 113, the second thermometer 114, and the third thermometer 115.

The classifying unit 40 classifies the transported defibrated materials into the ink particles and the fibers, such that the ink particles are removed. A cyclone 40, as the classifying unit 40, according to the embodiment is applied. As the cyclone 40, a tangential line input-type cyclone has a comparatively simple structure, and is preferable. In addition, instead of the cyclone 40, another kind of the airflow-type classifier may be used. In this case, as an airflow-type classifier other than the cyclone 40, for example, an Elbow-jet or an Eddy Classifier can be used. The airflow-type classifier generates the turning airflow, and performs separation and classification according to the difference of the centrifugal forces received depending on the size and the density of the defibrated material such that the classification point can be adjusted by the speed of the airflow and the adjustment of the centrifugal force.

The cyclone 40 according to the embodiment includes an introduction port 41 introduced from the defibrating unit 30, a cylindrical portion 43 to which the introduction port 41 is connected in a tangential direction, a conical portion 42 that extends to the cylindrical portion 43, a lower output port 46 provided on the lower portion of the conical portion, and an upper exhaust port 44 for discharging fine powder which is provided on the central and upper portion of the cylindrical portion 43.

In the classification process, the airflow carrying the defibrated materials introduced from the introduction port 41 of the cyclone 40 is changed to circumferentially move in the cylindrical portion 43, and moves to the conical portion 42. Also, separation and classification according to the difference of the centrifugal force received depending on the size and the size and the density of the defibrated material are performed. If products included in the defibrated materials are classified into two kinds of the fibers and the ink particles other than the fibers, the fibers are greater than the ink particles or have high density. Therefore, the defibrated materials are separated into the ink particles which are smaller than fibers and have low density and the fibers which are greater than the ink particles and have high density, by the classification process.

The separated ink particles are derived to the upper exhaust port 44 as fine powder together with the air. Also, relatively small ink particles which have low density are discharged from the upper exhaust port 44 of the cyclone 40. Also, the discharged ink particles are recollected from the upper exhaust port 44 of the cyclone 40 to the receiving unit 45 via a pipe 203. Meanwhile, the fibers that are greater than ink particles and have high density are transported from the lower output port of the cyclone 40 to the forming unit 70 as the defibrated fibers.

The additive feeding unit 60 that adds additives to the defibrated fiber is provided in the middle of a pipe 204 through which the defibrated fibers are transported from the cyclone 40 to the forming unit 70. As the additive, for example, a fusion resin, flame retardant, a whiteness improving agent, a paper strengthening agent, or a sizing agent is included. In addition, a portion or all of the additives may be omitted, or another additive may be further inserted. The additive is stored in a storage unit 61 and fed from a feed port 62 by a feeding mechanism (not illustrated).

A sheet is formed by using a mixture in which an additive is mixed with the defibrated fibers. Therefore, a mixture in which a fusion resin or an additive is mixed with the defibrated fibers is called a material fiber.

The forming unit 70 is obtained by depositing the material fibers so as to have an even thickness. The forming unit 70 has a mechanism of evenly dispersing the material fibers in the air and a mechanism of suctioning the material fibers on a mesh belt 73.

First, as the mechanism of evenly dispersing the material fibers in the air, a forming drum 71 in which material fibers are inserted inside thereof is arranged in the forming unit 70. The forming drum 71 may evenly mix the additive in the fiber by rotation. A screen with small holes is provided on the surface of the forming drum 71. The forming drum 71 is rotationally driven, the material fibers pass through the screen with small holes, and thus the material fibers can be evenly dispersed in the air.

Meanwhile, the endless mesh belt 73 in which meshes are formed is disposed vertically downward from the forming drum 71. The mesh belt 73 is stretched by plural stretching rollers 72, at least one of the stretching rollers 72 rotates, and thus the mesh belt 73 moves in one direction.

In addition, a suction device 75 that vertically downwardly generates the airflow is provided vertically downward from the forming drum 71 via the mesh belt 73. The material fibers dispersed in the air can be sucked onto the mesh belt 73 by the suction device 75.

If the material fibers are introduced into the forming drum 71 of the forming unit 70, the material fibers pass through the screen with small holes on the surface of the forming drum 71 and are deposited on the mesh belt 73 by the suction force of the suction device 75. At this point, the mesh belt 73 is caused to move in one direction, and thus the material fibers can be deposited in an even thickness. A deposit including the material fibers deposited in this manner is called a web W. In addition, the mesh belt may be made of metal, a resin, or a nonwoven fabrics, and any products can be used as long as the material fibers can be deposited and the airflow can pass. In addition, if the hole diameter of the mesh is too large, a surface of a sheet at the time of being formed becomes uneven. If the hole diameter of the mesh is too small, it is difficult to stabilize airflow by the suction device 75. Therefore, it is preferable that the hole diameter of the mesh is appropriately adjusted. The suction device 75 can be formed by forming a closed box in which a window in a desired size is open under the mesh belt 73, sucking the air in the box from the outside of the window, and causing the inside of the box to have low pressure.

The web W is transported in the web transporting direction illustrated by an arrow in FIG. 2 by moving the mesh belt 73. The moisture spraying unit 120 sprays and adds moisture to the transported web W. Accordingly, hydrogen bonds between the fibers can be reinforced. Also, the web W to which moisture is sprayed is transported to the pressurizing unit 80.

The pressurizing unit 80 pressurizes the transported web W. The pressurizing unit 80 includes two pairs of pressurizing rollers 81. The web W is compressed by causing the web W to which the moisture is sprayed to pass through a portion between the pressurizing rollers 81 facing each other. Also, the compressed web W is transported to the heating and pressurizing unit 90.

The heating and pressurizing unit 90 heats and pressurizes the transported web W at the same time. The heating and pressurizing unit 90 includes two pairs of heating rollers 91. The compressed web W is heated and pressurized by causing the compressed web W to pass through a portion between the heating rollers 91 facing each other.

In a state in which contact points between the fibers are increased by the pressurizing rollers 81 causing the distances between the fibers to be short, the fusion resin is melted by the heating rollers 91, such that the fibers are bound. Accordingly, the strength of the sheets are increased, the excessive moisture is dried, and thus excellent sheets are manufactured. In addition, with respect to the heating, it is preferable that the web W is pressurized and heated at the same time, by installing a heater in the heating rollers 91. In addition, a guide 108 guiding the web W is arranged under the pressurizing rollers 81 and the heating rollers 91.

The sheet (the web W) obtained as described above is transported to the cutting unit 100. The cutting unit 100 includes a cutter 101 that performs cutting in the transporting direction and a cutter 102 that performs cutting in the direction perpendicular to the transporting direction, and cuts the long sheets into a desired size. Cut sheets Pr (the webs W) are stacked on a stacker 160.

Figure 4:
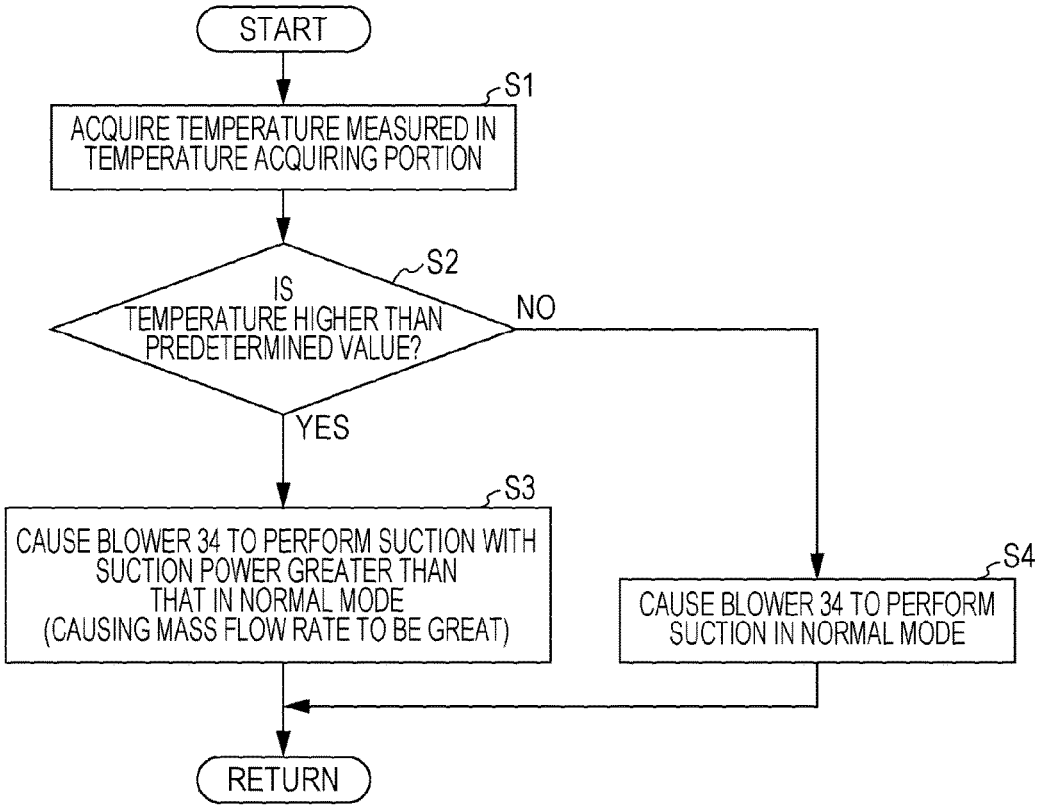
FIG. 4 is a flow chart illustrating a method for controlling a sheet-manufacturing device.

Subsequently, a method for controlling the sheet-manufacturing device is described. Specifically, a controlling method for controlling the suction force of the blower 34 according to the temperature of the acquired defibrating unit 30 is described. FIG. 4 is a flow chart illustrating a method for controlling a sheet-manufacturing device.

First, the temperature of the defibrating unit 30 is acquired. According to the embodiment, respective temperatures measured by the first thermometer 113, the second thermometer 114, and the third thermometer 115, as the temperature acquiring unit 110 are acquired (Step S1).

Subsequently, the mass flow rate of the air including the defibrated material transported from the defibrating unit 30 according to the acquired temperature is controlled.

The control unit decides whether the temperature acquired in Step S1 is higher than a predetermined temperature (Step S2). If the defibrating unit 30 is continuously driven, the temperature inside thereof gradually increases, and thus the predetermined temperature is set to be the temperature when the defibrating unit 30 is driven for a long time.

If the acquired temperature is not higher than the predetermined temperature (NO in Step S2), the defibrating unit 30 is in a state of being normally driven, and in this case, the blower 34 as the suction unit is controlled in a normal mode and performs suction (Step S4).

Meanwhile, if the acquired temperature is higher than the predetermined temperature (YES in Step S2), the defibrating unit 30 is in a state of being driven for a long time. With respect to the controlling of the blower 34 in this case, the mass flow rate of the air is caused to be great by performing suction by the suction force greater than that in Step S4 (Step S3).

According to the embodiment, if the acquired temperature is higher than the predetermined temperature, the suction force of the blower 34 is caused to be greater than that in the normal mode. Accordingly, the mass flow rate of the air is caused to be great, such that the transportation properties of the defibrated materials are improved. Also, the generation of the short fiber is suppressed since the excessive defibrated state of the defibrating unit 30 is cancelled.

In addition, according to the embodiment, the temperature is divided according to whether the temperature is higher than the predetermined temperature, but may be divided according to whether the temperature is lower than the predetermined temperature. In addition, plural predetermined temperatures may be prepared, and the temperatures may be divided into three according to the number of the prepared predetermined temperatures. The predetermined temperatures in this case refer to plural temperatures including the temperature when driving is performed for a long time. In addition, the temperature may not be compared with the predetermined temperature, and the acquired temperatures may be compared with each other. In any cases, when the acquired temperature is higher, the mass flow rate becomes greater than that when the acquired temperature is lower, such that the suction force increases.

Hereinafter, according to the embodiment, the following effects can be obtained.

(1) The temperature of the defibrating unit 30 is measured by the temperature acquiring unit 110, and, for example, if the temperature of the defibrating unit 30 is high, the suction force of the blower 34 as the suction unit increases. Accordingly, the transportation properties of the defibrated material in the defibrating unit 30 are improved, the excessive defibrated state is cancelled, short fibers are scarce, and thus a sheet having the secured strength can be manufactured.

In addition, the invention is not limited to the embodiments described above, and various modifications, improvements, and the like can be added to the embodiments described above. The modification examples are described below.

According to the embodiment, the first thermometer 113 measures the temperature inside the defibrating unit 30, but the invention is not limited thereto. The invention may be configured such that the temperature of the surface outside the defibrating unit 30 is measured. In addition, the invention may have a configuration in which the second thermometer 114 and the third thermometer 115 measure the temperatures of the surface outside the upstream transporting path 25 and the downstream transporting path 35 in the same manner. Also in this manner, the temperature changes of the respective portions can be easily acquired, such that the same effect can be obtained.

According to the embodiment described above, the first thermometer 113, the second thermometer 114, and the third thermometer 115 are provided as the temperature acquiring unit 110, but the invention is not limited to this configuration. If three thermometers are used, while the temperatures inside the defibrating unit 30 are obtained, the rising state of the temperature of the defibrated materials in the defibrating unit 30 can be obtained by the temperature differences between the upstream and the downstream of the defibrating unit 30. However, only the temperature in the defibrating unit 30 may be obtained only with the first thermometer 113. In addition, the temperature difference between the upstream and downstream of the defibrating unit 30 may be obtained by including the second thermometer 114 and the third thermometer 115 only. In addition, only the third thermometer 115 may be included. If two of the second thermometer 114 and the third thermometer 115 are included, or one of the third thermometer 115 is included, since the temperatures of defibrated materials passing through a portion inside the defibrating unit 30 can be estimated, it can be considered that the temperature of the defibrating unit 30 is acquired. In this manner, the cost can be decreased by reducing the number of thermometers.

In addition, a thermometer may be added to the first thermometer 113, the second thermometer 114, and the third thermometer 115. In this manner, more specifically, the temperature of the defibrating unit 30 and the temperature near the defibrating unit 30 can be acquired.

According to the embodiment, the mass flow rate of the air including the defibrated materials transported from the defibrating unit 30 is changed by controlling the blower 34, but the invention is not limited to this configuration. For example, a wind generating mechanism that generates airflow is arranged in the defibrating unit 30. Specifically, the defibrating unit 30 includes a rotary blade that rotates, the control unit controls the number of rotations of the rotary blade depending on the acquired temperature. For example, when the acquired temperature is higher than the predetermined temperature, the rotation speed of the rotary blade is caused to be greater than that when the acquired temperature is lower than the predetermined temperature. In this manner, since the mass flow rate of the air increases, the excessive defibrated state is cancelled, and thus an appropriate defibration can be performed. In addition, blades (such as impeller blades) that generate airflow may be provided in addition to the rotary blade so as to rotate together with the blades.

According to the embodiments described above, the mass flow rate of the air including the defibrated materials transported from the defibrating unit 30 is changed by controlling the blower 34, but the invention is not limited to this configuration. For example, the mass flow rate of the air including the defibrated materials transported from the defibrating unit 30 may be changed by controlling the suction device 75 of the forming unit 70.

In addition, the introduction force that introduces the air to the defibrating unit 30 may be controlled not by perform suction from the downstream side of the defibrating unit 30, but by providing an airflow introducing unit on the upstream side of the defibrating unit 30, so as to control the airflow. In addition, the introduction force may be controlled not by providing the airflow introducing unit, but by introducing exhaust gas from the suction device 75 to the defibrating unit 30. The same effect can be obtained by causing the introduction force from the airflow introducing unit to be great and causing the suction force by the suction unit to be great.

According to the embodiment, the temperature of the defibrating unit 30 is directly acquired by the first thermometer 113, but the invention is not limited to this configuration. For example, as illustrated in FIG. 3, a flow meter 116 that measures the flow rate of the air may be provided in the downstream transporting path 35, the measurement value of the flow meter 116 is used, such that the temperature in the defibrating unit 30 by calculation or using a data table created in advance may be obtained. If the temperature increase, the mass flow rate decreases and thus the flow rate may be measured without measuring the temperature. Therefore, it can be considered that the flow meter 116 is the temperature acquiring unit 110. Also in this manner, the effect described above can be obtained.

The "sheet" according to the embodiment mainly refers to a sheet which is made from the raw material comprising fibers such as waste paper or fibers such as pure pulp. However, the invention is not limited thereto, but may be a board shape or a web shape (or shape having unevenness). In addition, as the raw material, a plant fiber such as cellulose, chemical fibers such as polyethylene terephthalate (PET) and polyester, or animal fibers such as wool or silk may be used. The sheet according to the invention can be classified as paper and nonwoven material. The paper includes embodiments in a thin sheet, and includes recording paper for the purpose of writing and printing, wallpaper, wrapping paper, colored paper, Kent paper, or the like. The nonwoven materials are products thicker than paper or products having low strength, and includes typical nonwoven materials, a fiber board, tissue paper, paper towel, a cleaner, a filter, a liquid absorbing material, a sound absorbing body, a buffer material, a mat, and the like.

REFERENCE SIGNS LIST

1 SHEET-MANUFACTURING DEVICE
10 SUPPLYING UNIT
20 CRUSHING UNIT
25 UPSTREAM TRANSPORTING PATH
30 DEFIBRATING UNIT
35 DOWNSTREAM TRANSPORTING PATH
40 CLASSIFYING UNIT (CYCLONE)
45 RECEIVING UNIT
60 ADDITIVE FEEDING UNIT
70 FORMING UNIT
80 PRESSURIZING UNIT
90 HEATING AND PRESSURIZING UNIT
100 CUTTING UNIT
110 TEMPERATURE ACQUIRING UNIT
113 FIRST THERMOMETER
114 SECOND THERMOMETER
115 THIRD THERMOMETER
116 FLOW METER

The invention claimed is:

1. A sheet-manufacturing device comprising:

a defibrating unit configured to generate a defibrated material by defibrating a defibration object;

a temperature acquiring unit configured to acquire a temperature of the defibrating unit; and a control unit configured to change a mass flow rate of the air including the defibrated material transported from the defibrating unit, the control unit being configured to increase the mass flow rate of air upon the acquired temperature being higher than a predetermined temperature.

2. The sheet-manufacturing device according to claim 1, further comprising:

a suction unit configured to suction the defibrated material, wherein, the control unit is configured to increase a suction force of the suction unit upon the temperature being higher than the predetermined temperature.

3. The sheet-manufacturing device according to claim 1, wherein the defibrating unit includes a rotary blade that rotates, and wherein, the control unit is configured to increase a rotation speed of the rotary blade upon the temperature being higher than the predetermined.

4. The sheet-manufacturing device according to claim 1, wherein, the temperature acquiring unit is configured to acquire the temperature inside the defibrating unit.

5. The sheet-manufacturing device according to claim 1, wherein an upstream side and a downstream side of the defibrating unit in a transporting direction of the defibrated material are connected to an upstream transporting path and a downstream transporting path, respectively, and wherein, the temperature acquiring unit is configured to acquire temperatures inside the upstream transporting path and inside the downstream transporting path.

* * * * *